United States Patent [19]

Takizawa

[11] 4,247,839

[45] Jan. 27, 1981

[54] ELECTROGRAPHIC APPARATUS HAVING AN IMPROVED EXIT OPENING PORTION

[75] Inventor: Tatsuo Takizawa, Sagamihara, Japan

[73] Assignee: Olympus Optical Co., Ltd., Tokyo, Japan

[21] Appl. No.: 24,362

[22] Filed: Mar. 27, 1979

[30] Foreign Application Priority Data

Jun. 1, 1978 [JP] Japan ..... 53-73492[U]

[51] Int. Cl.[3] ..... G03G 15/00

[52] U.S. Cl. ..... 355/3 R; 355/3 SH; 355/133

[58] Field of Search ..... 355/3 R, 3 SH, 5, 11, 355/133; 354/277, 86, 87

[56] References Cited

U.S. PATENT DOCUMENTS

| | | | |
|---|---|---|---|
| 3,810,211 | 5/1974 | Wareham et al. | 354/86 |
| 3,850,520 | 11/1974 | Washio et al. | 355/3 SH |

*Primary Examiner*—R. L. Moses

*Attorney, Agent, or Firm*—Haseltine and Lake

[57] ABSTRACT

An electrographic apparatus provided at its exit opening portion through which a record sheet with a copied picture image formed thereon passes with eaves for preventing a photosensitive body from being exposed to an exterior light entering from the exit opening.

4 Claims, 4 Drawing Figures

ELECTROGRAPHIC APPARATUS HAVING AN IMPROVED EXIT OPENING PORTION

BACKGROUND OF THE INVENTION

1. Field of the Invention

This invention relates to an electrographic apparatus and more particularly to an improvement in an exit opening portion through which a record sheet with a copied picture image formed thereon is delivered.

2. Description of the Prior Art

Various kinds of electrographic apparatus have been proposed and used in practice which make use of a photosensitive body on which is produced an electrostatic latent image corresponding to a manuscript to be copied.

In such electrographic apparatus, the electrostatic latent image is developed into a toned image which is then transferred onto a record sheet so as to form a copied picture image thereon. In this case, it is particularly important to maintain a photosensitive characteristic of the photosensitive body for a long time in a stable manner. For this purpose, the photosensitive body must effectively be shielded from an exterior light. That is, if the photosensitive body is exposed to the exterior light, the premature fatigue failure of the photosensitive body becomes induced, the electrostatic latent image becomes deteriorated or erased or the like, thereby exerting an adverse influence on the copying characteristic of the photosensitive body. In order to obviate such drawback, in the conventional electrographic apparatus, it has been the common practice to surround the photosensitive body with a light screening member in an apparatus main body or to construct the apparatus main body without openings so as to prevent the exterior light from penetrating into the photosensitive body.

But, it is very troublesome to surround the photosensitive body with the light screening member and the assembly thus obtained is complex in construction. In addition, even though the apparatus main body is constructed without openings, the apparatus main body must be provided with an exit opening through which is delivered a record sheet with a copied picture image formed thereon. As a result, there is a risk of the inside of the apparatus main body being exposed to exterior light penetrated through the exit opening. The exterior light is penetrated through the exit opening in each and every direction and particularly the exterior light substantially rectilinearly incident on the photosensitive body without being reflected on various kinds of members in the apparatus main body exerts a bad influence on the photosensitive body. This exterior light is penetrated through a record sheet feeding path into the inside of the apparatus main body and incident on the photosensitive body. That is, the photosensitive body is adjacent to the record sheet feeding path or is located on an extension line drawn from the exit opening in the record sheet delivering direction.

In the conventional electrographic apparatus, it has been proposed to provide a tortuous record sheet feeding path or displace the exit opening into the apparatus main body such that the exterior light substantially rectilinearly incident on the photosensitive body from the exit opening can be shielded.

But, the use of the former measures of making the record sheet feeding path tortuous results in a long record sheet feeding path and makes the apparatus main body complex in construction and large in size. The use of the latter measures of displacing the exit opening into the apparatus main body also makes the apparatus main body complex in construction and large in size.

An electrographic apparatus for obtaining a plurality of copies from an electrostatic latent image corresponding to a manuscript image and produced on a photosensitive body has recently be proposed. Such apparatus can obtain a plurality of copies on the basis of the electrostatic latent image without subjecting the same manuscript to subsequent exposure scanning steps after the electrostatic latent image has been formed. The exterior light is directed substantially rectilinearly without being reflected on various kinds of members in the apparatus main body and does not exert a bad influence on the photosensitive body. This exterior light is penetrated through a record sheet feeding path into the inside of the apparatus main body and incident on the photosensitive body. That is, the photosensitive body is adjacent to the record sheet feeding path or is located on an extension line drawn from the exit opening in the record sheet delivering direction.

SUMMARY OF THE INVENTION

An object of the invention, therefore, is to provide an electrographic apparatus which can eliminate the above mentioned drawback, that is which is small in size and simple in construction and which can effectively shield the exterior light which enters into a record sheet exit opening and passes through a record sheet feeding path and incidents on a photosensitive body.

A feature of the invention is the provision of an electrographic apparatus comprising light shielding eaves located at an exit opening portion through which a record sheet with a copied picture image formed thereon passes and crossing over a delivery direction of said record sheet, said eaves being constructed such that the exterior light entering from the exit opening through a record sheet feeding path is prevented from being incident on a photosensitive body.

Further objects and features of the invention will be fully understood from the following detailed description with reference to the accompanying drawings, in which:

DETAILED DESCRIPTION OF THE PREFERRED EMBODIMENTS

Figure 1:
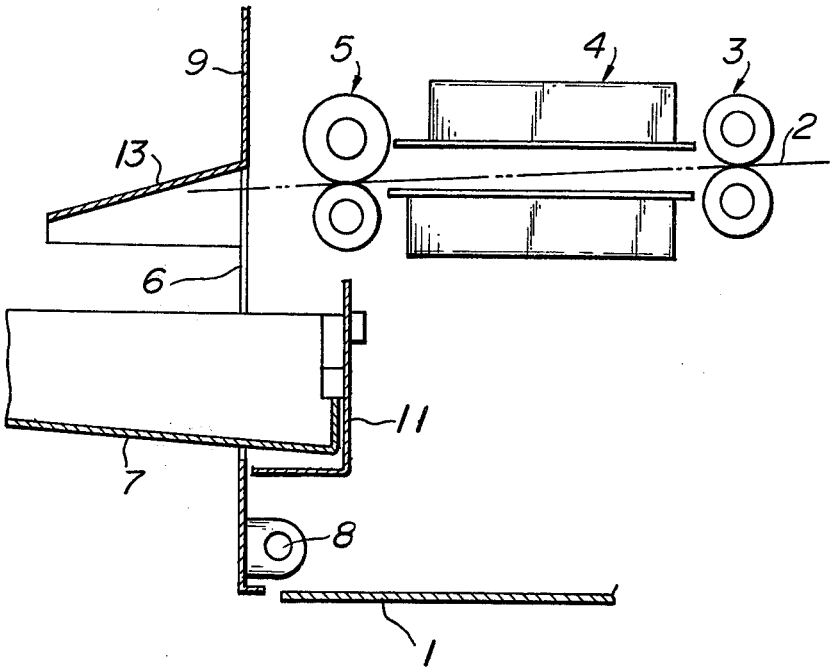
FIG. 1 is a vertical longitudinal section taken through essential parts of one embodiment of an electrographic apparatus according to the invention.
Figure 2:
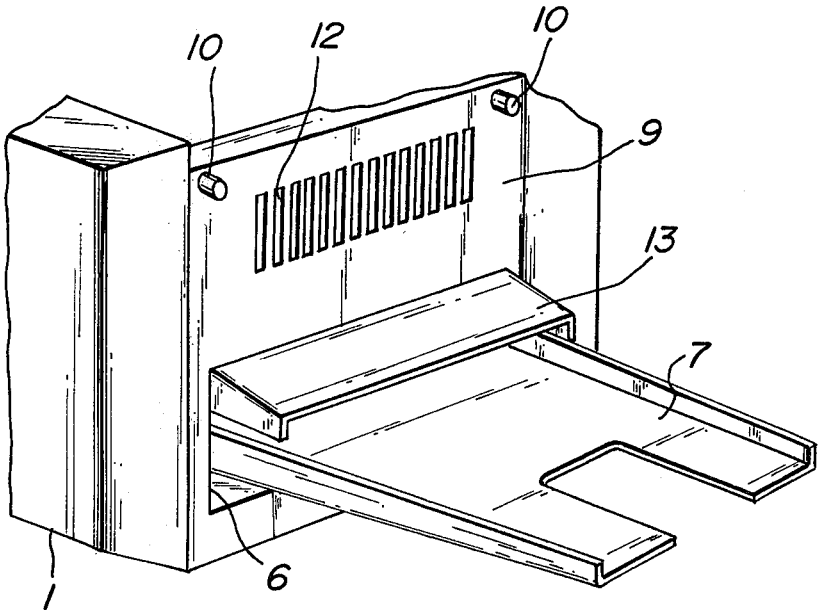
FIG. 2 is its front perspective view.

FIG. 1 shows essential parts of one embodiment of an electrographic apparatus according to the invention and FIG. 2 its front perspective view. Referring to FIGS. 1 and 2, reference numeral 1 designates an electrographic apparatus main body which is provided therein with a photosensitive body, means for producing, on the photosensitive body, an electrostatic latent image, a developing means and a transfer means, necessary for effecting a copying step.

In the present embodiment, in order to make the apparatus as a whole small in size, provision is made of a substantially rectilinearly extending record sheet feeding path 2, thereby simplifying its construction.

A record sheet with a copied picture image formed thereon (not shown) is fed through a pair of feed rollers 3 into a heat fixing device 4 where the copied picture image, that is, a toned image is fixed by fusing to the record sheet.

In the present embodiment, the heat fixing device 4 is composed of a pair of containers each enclosing therein a heat supply source and arranged on both sides of the record sheet feeding path 2, respectively. The record sheet fixed by the heat fixing device 4 passes through a pair of outlet rollers 5 to an exit opening 6 from which is delivered into a copy tray 7.

In the present embodiment, the exit opening 6 is provided in a cover plate 9 rotatably mounted on a side plate of the apparatus main body 1 by means of a hinge 8.

The free end of the cover plate 9 is detachably engaged with the side of the apparatus main body 1 by means of screw threaded knobs 10. The copy tray 7 is detachably mounted on a fitting members 11 inserted through the exit opening 6 into the apparatus main body 1 and secured thereto.

After the copy tray 7 has been removed, the threadedly engaged knobs 10 are disengaged from the side plate of the apparatus main body 1 and then the cover plate 9 is downwardly rotated about the hinge 8 toward the outside of the apparatus main body 1. As a result, it is possible to easily restore the clogged condition of the record sheet feeding path to its normal condition. The cover plate 9 is provided at its upper portion with a louver window 12.

Figure 3:
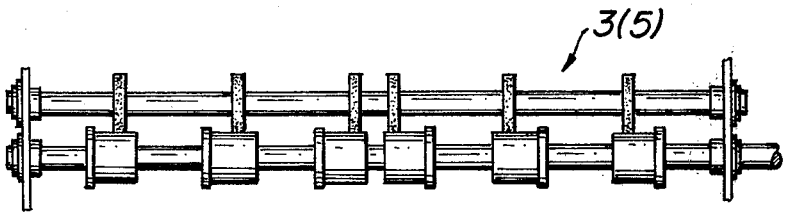
FIG. 3 is a front elevation showing one embodiment of a pair of feed rollers and a pair of outlet rollers.

FIG. 3 shows a pair of feed rollers 3 which are the same in construction as a pair of outlet rollers 5. These rollers are composed of large diameter portions provided on rotary shafts and spaced apart from each other, one of the rotary shafts being a driving shaft while the other rotary shaft being a driven shaft. The lower rollers made contact with that lower surface of the record sheet which is opposite to the copied picture image produced surface are driven so as to feed the record sheet. The rollers which make contact with the copied picture image surface are made small in width for the purpose of preventing the copied picture image from being damaged by the roller surface. As a result, both the pair of feed rollers 3 and pair of outlet rollers 5 partly engage with each other.

In the present embodiment, the cover plate 9 is provided at its exit opening portion 6 with a light shielding eaves 13 crossing over the record sheet feeding path 2 including the pairs of feed and outlet 7 rollers 3, 5, heat fixing device 4 and spaces formed therebetween and projected from the cover plate 9 to the outside of the apparatus main body 1. The use of such eaves 13 ensures an effective shield of the exterior light incident in the direction of the record sheet feeding path even though the path extends rectilinearly, thereby preventing the photosensitive body from being exposed to the exterior light. As a result, the photosensitive property of the photosensitive body is effectively maintained for a long time and it is possible to effectively obtain a plurality of copies from the same electrostatic latent image. In addition, the light shielding eaves 13 are inclined with respect to the record sheet feeding path 2, and hence function to guide the record sheets delivered from the exit opening 6 onto the copy tray 7 one upon the other in a stable manner.

The record sheet feeding path 2 crosses over the eaves 13, so that the front end of the record sheet delivered from the exit opening 6 is fed along the inclined surface of the eaves 13. As a result, the record sheet delivered from the exit opening 6 advances toward the surface of the copy tray 7 by means of the delivering direction of the record sheet and a mutual relation between the inclined angle of the eaves 13 and an angle of the copy tray 7 inclined upwardly with respect to the apparatus main body 1. Then, the front end of each of the record sheets makes contact with the copy tray surface and then advances therealong so as to be superimposed one upon the other.

It is preferable to make a portion adjacent to the exit opening 6 and the eaves 13 black in color for the purpose of preventing a secondary reflective light or the like from penetrating through the exit opening 6.

Figure 4:
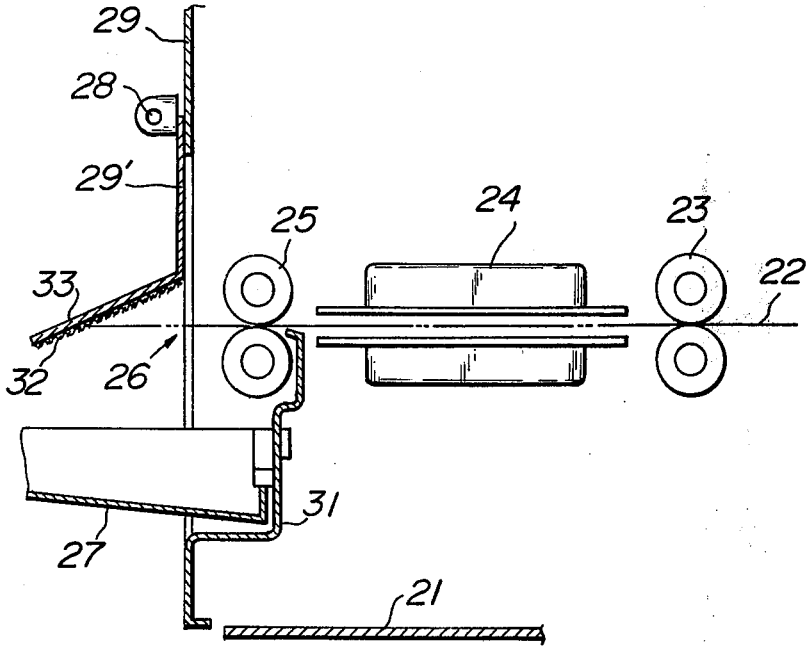
FIG. 4 is a vertical longitudinal section taken through essential parts of another embodiment of an electrographic apparatus according to the invention.

FIG. 4 shows another embodiment of an electrographic apparatus according to the invention. Referring to FIG. 4, reference numeral 21 designates an electrographic main body, 22 a substantially rectilinearly extending record sheet feeding path, 23 a pair of feed rollers, 24 a heat fixing device, 25 a pair of outlet rollers, 26 an exit opening, 27 a copy tray, 29 a cover, and 31 a fitting member. All of these members are the same in construction as those shown in FIG. 1. In the present embodiment, eaves 33 similar in construction to the eaves 13 shown in FIG. 1 are made integral with a cover portion 29' and rotatably mounted through the cover portion 29' on the side plate of the apparatus main body 21 by means of a hinge 28 such that the eaves 33 can upwardly be rotated so as to remove the clogging or the like of the record sheet in the record sheet feeding path 22. In order to prevent the exterior light from penetrating through the lower side of the eaves 33 into the record sheet feeding path 22, the record sheet feeding path 22 may be provided at its lower side with a light shielding plate.

In addition, the eaves 33 are coated on their lower surface which makes contact with the record sheet with an electrically conductive fiber or a cloth formed of the electrically conductive fiber 32, thereby permitting the electric charge on the record sheet to discharge and hence preventing the record sheets from being attracted with each other due to electrostatic attractive force. As a result, it is possible to deliver the record sheets through the exit opening 26 into the copy tray 27 in a positive manner.

It is preferable to locally loosen or nap the cloth 32 formed of the electrically conducted fiber for the purpose of easily discharging the electric charge on the record sheet.

What is claimed is:

1. An electrographic apparatus comprising: a main body; a cover plate rotatably mounted on a side plate of said main body and provided with an exit opening; a photosensitive body for producing an electrostatic latent image thereon for obtaining a plurality of copies; a rectilinear record sheet feeding path extending from said exit opening to said photosensitive body; a pair of feed rollers partly engaged with each other and feeding a record sheet along said rectilinear record feeding path; a pair of outlet rollers spaced apart from said feed rollers and partly engaged with each other, for delivering said record sheet along said rectilinear record feeding path; a heat fixing device formed of a pair of containers each enclosing therein a heat supply source, being arranged on both sides of said rectilinear record feeding path; and light shielding eaves integral with said cover plate and extending transversely and inclined to said rectilinear record feeding path.

2. The electrographic apparatus according to claim 1, wherein said cover plate is downwardly rotatable about a hinge secured to a lower part of a side plate of an apparatus main body.

3. The electrographic apparatus according to claim 1, wherein said cover plate portion being upwardly rotatably about a hinge secured to an upper part of a side plate of an apparatus main body.

4. The electrographic apparatus according to claim 1, wherein said eaves are coated on their lower surface which makes contact with the record sheet with an electrically conductive fiber or a cloth formed of the electrically conductive fiber.

* * * * *